United States Patent [19]

Reist

[11] Patent Number: 4,743,005

[45] Date of Patent: May 10, 1988

[54] APPARATUS FOR STUFFING INSERTS INTO MULTI-SHEET PRINTED PRODUCTS

[75] Inventor: Walter Reist, Hinwil, Switzerland

[73] Assignee: Ferag AG, Hinwil, Switzerland

[21] Appl. No.: 31,663

[22] Filed: Mar. 30, 1987

[30] Foreign Application Priority Data

Apr. 4, 1986 [CH] Switzerland ..... 1338/86

[51] Int. Cl.[4] ..... B65H 5/30

[52] U.S. Cl. ..... 270/55; 271/204

[58] Field of Search ..... 270/54–58, 270/1; 271/204–206, 277, 82; 198/696

[56] References Cited

U.S. PATENT DOCUMENTS

| | | | |
|---|---|---|---|
| 3,122,362 | 2/1964 | Vollrath et al. | 270/57 |
| 3,955,667 | 5/1976 | Muller et al. | 271/204 X |
| 4,046,367 | 9/1977 | Merker et al. | 270/55 |
| 4,126,390 | 11/1978 | Connin | 271/204 |
| 4,381,056 | 4/1983 | Eberle | 198/696 |
| 4,398,710 | 8/1983 | Hansch | 270/55 |
| 4,477,067 | 10/1984 | Wise | 270/55 |
| 4,479,645 | 10/1984 | Pollich | 271/204 X |
| 4,496,141 | 1/1985 | Nayate | 270/55 |
| 4,604,851 | 8/1986 | Reist | 271/204 |
| 4,706,951 | 11/1987 | Leu | 270/55 |

FOREIGN PATENT DOCUMENTS

| | | | |
|---|---|---|---|
| 2508294 | 9/1976 | Fed. Rep. of Germany . | |
| 2822060 | 12/1978 | Fed. Rep. of Germany | 271/204 |
| 417647 | 7/1966 | Switzerland . | |
| 641113 | 2/1984 | Switzerland . | |
| 973639 | 10/1964 | United Kingdom . | |

*Primary Examiner*—Eugene H. Eickholt

*Attorney, Agent, or Firm*—Werner W. Kleeman

[57] ABSTRACT

A multiplicity of similar pockets open at their top and each serving for the reception of a printed product are attached in a closely spaced or uninterrupted row at endless revolving drive elements which move in a direction transversely to the direction of extent of the open pockets. These pockets successively travel to infeed stations for the printed products and the inserts. Each pocket is equipped with a mechanism for opening the printed product located therein. To reduce to a minimum the number of movable components in each pocket and to attain a faultless or proper alignment of the printed products with the inserts and which are collated together for forming a final product, each pocket is provided with an entrainment element intended for the reception of a printed product. This entrainment element is controllably displaceable, transverse to the direction of revolving motion of the pockets, between a first terminal position and a second terminal position. In each pocket there is provided an opening element, such as an opening wedge, which is stationary in relation to the associated pocket. This opening wedge opens the printed product which is entrained by the entrainment element during the course of displacement of the entrainment element from its first terminal position into its second terminal position.

11 Claims, 4 Drawing Sheets

APPARATUS FOR STUFFING INSERTS INTO MULTI-SHEET PRINTED PRODUCTS

BACKGROUND OF THE INVENTION

The present invention relates to a new and improved construction of an apparatus or installation for inserting or stuffing inserts into folded or bound, multi-sheet printed products or the like.

In its more specific aspects, the present invention relates to a new and improved construction of stuffing apparatus for inserting or stuffing inserts into multi-sheet printed products, especially into newspapers, which stuffing apparatus is of the type comprising a plurality of similar pockets each serving for the reception of a printed product or the like. These pockets are open at their top or upper region and are secured in an essentially uninterrupted or closely spaced row at endless revolving or circulating drive elements which move in a direction transverse to the direction of extent of the pocket opening. These pockets are successively moved past infeed stations for respectively infeeding the printed products and the inserts as well as past an unloading or discharge station for removing the finalized stuffed printed product. Furthermore, each pocket is provided with a mechanism or facility for opening the printed products to accomplish the insert stuffing operation.

Such type of product stuffing apparatuses or installations are particularly, although not exclusively, suitable for incorporating or stuffing inserts into printed products having an appreciable weight, for instance containing 100 sheets and more, so that the final product constitutes in toto a product package containing hundreds of loosely interstuffed sheets. This is particularly the case, for instance, for the weekend editions of newspapers in English-language countries.

A heretofore known prior art apparatus of the previously mentioned type has been disclosed, for instance, in U.S. Pat. No. 4,496,141, granted Jan. 29, 1985. With this prior art apparatus the pockets describe a circulating or revolving path of travel which is located in a horizontal plane. The mechanism provided within each pocket and serving for opening the printed product located in such related pocket comprises a multiplicity of movable elements. These elements are, first of all, constituted by a movable contact plate which forces the printed product introduced into the pocket against one of the walls of the related pocket. Additionally, such elements embody a pair of suction cups which engage in a controlled manner at the oppositely situated flat sides of the printed product and thereafter again separate from one another, resulting in the formation of a gap or opening in the printed product. Into this gap or opening there then engages as the third movable element a pivotable opening sword or element which, by virtue of its pivotal motion, completes the product opening operation.

Both the contact plate and also the suction cups and the opening swords are each controlled by a gear train which coacts with a follower element retained in its rest position by the spring force of a resilient or spring element. This follower is moved against the action of the spring by an appropriately configured, stationary cam structure or cam.

It will be apparent from the foregoing that the opening mechanism of the heretofore known apparatus not only requires an appreciable technological expenditure and equipment, but also consumes a great deal of drive power, since all of the movements of the movable elements and the gear train associated therewith are derived from the revolving motion of the "circulating pockets" in relation to the appropriately configured, stationary cam structures or cams.

SUMMARY OF THE INVENTION

Therefore, with the foregoing in mind it is a primary object of the present invention to provide a new and improved construction of product stuffing apparatus which is not afflicted with the aforementioned drawbacks and shortcomings of the prior art construction.

Another and more specific object of the present invention is directed to a new and improved construction of a stuffing apparatus for inserting or stuffing inserts into principal products, typically printed products in a highly reliable and efficient manner, wherein the stuffing apparatus contains very few moving parts and thus has relatively modest power requirements.

Still a further noteworthy object of the present invention is directed to a new and improved construction of a stuffing apparatus for inserting or stuffing inserts into printed products, wherein the stuffing apparatus is provided with a sequence of closely spaced pockets attached to conveyor means moving in a predetermined direction, each of the pockets being provided with a facility for displacement of the inserted product or article or the like from one terminal position to another terminal position in a direction transverse to the predetermined direction of movement of the pockets, and during such transverse movement the printed product or article or the like inserted into its associated pocket is opened and during the course of the pocket movement in the aforesaid predetermined direction stuffed with the inserts, whereafter the stuffed printed product is returned into the initial terminal position where it can be removed as a final or completed product.

Yet a further significant object of the present invention aims at providing a new and improved construction of a product stuffing apparatus for inserting or stuffing inserts into a printed product, which stuffing apparatus is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the stuffing apparatus for stuffing or inserting inserts into printed products is manifested by the features that an entrainment element is arranged in each pocket and serves for the reception of a printed product. Each such entrainment element can be controllably displaced or shifted transverse to the direction of revolving or circulating motion of the pockets from a first terminal or end position into a second terminal or end position. Within each pocket there is also provided a product opening member, such as an opening wedge, which is mounted so that it is stationary in relation to the associated pocket. This opening wedge or wedge member opens the printed product entrained by the related entrainment element during the course of the movement of the entrainment element and the printed product entrained thereby from the first terminal position into the second terminal position.

In contrast to the heretofore known apparatus, with the stuffing apparatus or installation of the present development the printed products introduced or inserted into the pockets are displaced by the entrainment element within the associated pocket. This enables designing the opening mechanism as a very simple opening wedge or wedge member or equivalent structure which is immobile or stationary in relation to the associated pocket, and additionally, affords a relatively perfect alignment of the printed products in successive pockets in relation to one another when the entrainment element is located in the second terminal or end position.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
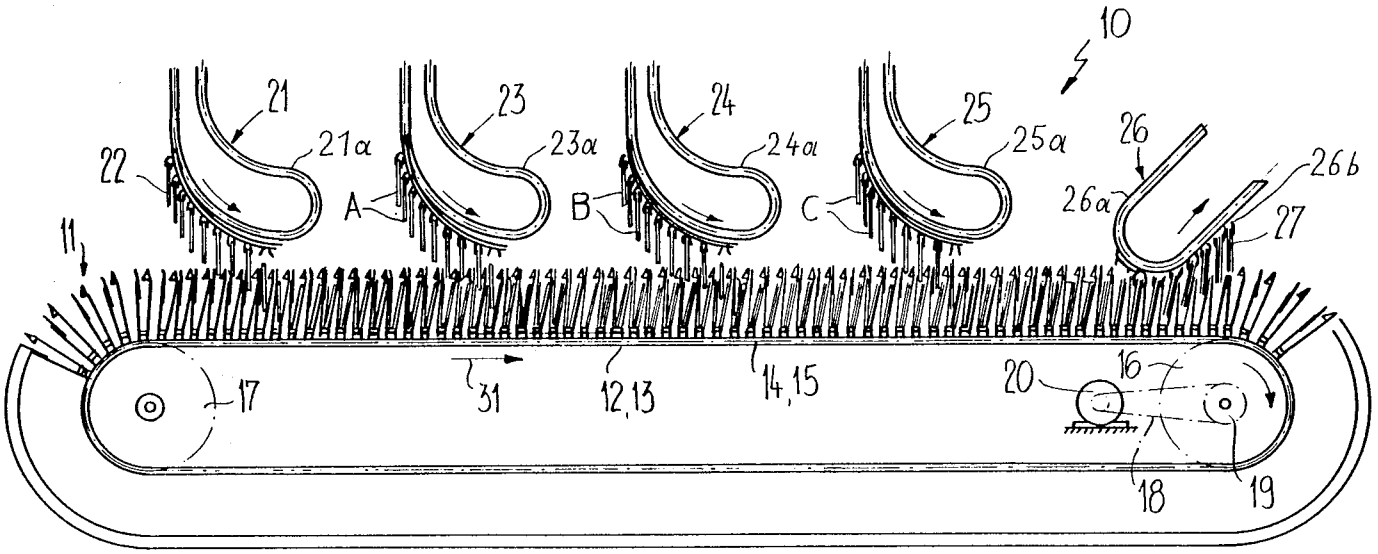
FIG. 1 illustrates a schematic side view of a product stuffing or inserting apparatus constructed according to the present invention.

Describing now the drawings, it is to be understood that to simplify the showing thereof, only enough of the product stuffing apparatus for inserting or stuffing inserts or the like into principal product sections, such as printed products, has been illustrated therein as is needed to enable one skilled in the art to readily understand the underlying principles and concepts of this invention. Turning attention now to FIG. 1 of the drawings, the product stuffing apparatus or installation 10 depicted therein will be seen to comprise a multiplicity of pockets or pocket members 11 which are closely or snugly arranged behind one another or in tandem relationship in the manner of wrungs of a ladder. As will also be seen by referring to FIGS. 4 and 5 these pockets or pocket members 11 are secured to two endless, substantially mutually parallel revolving or circulating driven drive elements, here shown in the form of chains 14 and 15, which are guided in the associated rails 12 and 13, respectively. Each of the chains or chain members 14 and 15 is guided over a driven sprocket wheel 16 (in FIG. 1 only one of the sprocket wheels is depicted) and is trained about a deflection wheel 17 (in FIG. 1 only one such deflection wheel has been conveniently illustrated). The depicted driving sprocket wheel 16 is driven through the intermediary of a drive chain 18 by a suitable drive motor 20 in the direction of the arrow depicted at the right-hand side of FIG. 1. This drive chain 18 or equivalent drive element meshes with a sprocket wheel 19 arranged coaxially with respect to the sprocket wheel 16. The sprocket wheel 19 is rigidly connected for conjoint rotation with the sprocket wheel 16.

The pockets or pocket members 11 thus form a closely spaced or essentially closed row of pockets or pocket sequence which revolves or circulates in a substantially vertical plane, and the upper appearing pocket run of FIG. 1 will be conveniently designated as the so-called active run of pockets, whereas the lower situated run of pockets will be conveniently referred to as the empty return moving run of empty pockets.

Belonging to the depicted exemplary embodiment of product stuffing apparatus are a number of infeed devices or infeeders and an outfeed or delivery device or outfeeder which, in the depicted arrangement, comprise a plurality of individual conveyors or conveyor structures each equipped with controlled grippers as is well-known in this technology. Such individual conveyors have been disclosed in detail, for instance, in U.S. Pat. No. 3,955,667 or in the Austrian patent No. 361,517, to which reference may be readily had and the disclosures of which are incorporated herein by reference. The infeed device or infeeder 21 depicted at the left-hand side of the arrangement of FIG. 1 has only been conveniently depicted with its product delivery or outfeed region or section 21*a*. This infeed device or infeeder 21 serves to deposit into each of the pockets or pocket members 11 moving therepast one of the principle products, here assumed to be printed products, and specifically for instance newspapers 22, with the folds or fold portions F thereof leading.

Also in FIG. 1 there have been depicted three additional or further infeed devices or infeeders 23, 24 and 25 which only have conveniently depicted their respective delivery or outfeed region 23*a*, 24*a* and 25*a*. These infeed devices or infeeders 23, 24 and 25, viewed with respect to the direction of revolving or circulating motion of the pockets or pocket members 11, are arranged in succession or tandem relationship and after or downstream of the first product infeed device or infeeder 21. From the illustration of FIG. 2, in which there has been omitted for purposes of simplification of the portrayal thereof, the infeed device or infeeder 25, it will be recognized that the delivery or outfeed regions 23*a*, 24*a* and 25*a* of the respective infeed devices or infeeders 23, 24 and 25, viewed in the direction of revolving or circulating motion 31 of the pockets or pocket members 11, are essentially in alignment with one another, however are arranged in offset relationship with respect to the delivery or outfeed region 21*a* of the infeed device or infeeder 21. These infeed devices or infeeders 23, 24 and 25 serve to introduce or stuff into each of the previously opened newspapers 21 prevailing within an associated pocket 11 a respective insert, and which inserts, in the embodiment under discussion, have been conveniently designated by reference characters A, B and C. The product opening mechanism, here the opening mechanism for the newspapers 22, will be described in greater detail hereinafter.

Figure 2:
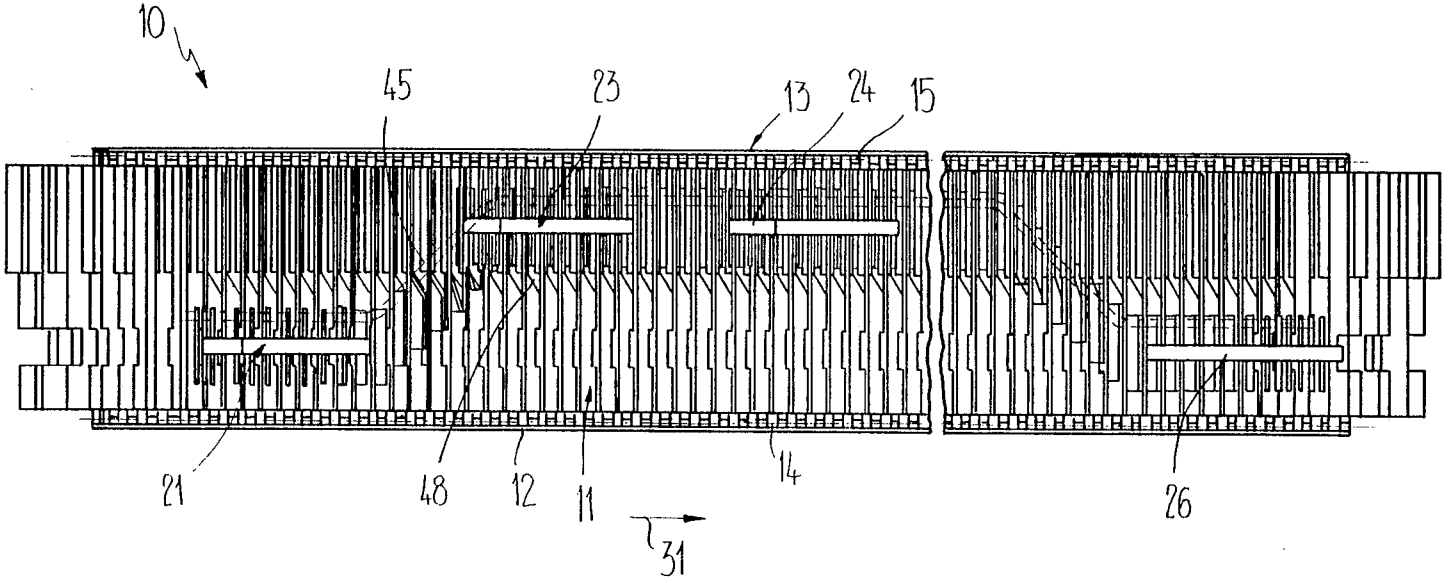
FIG. 2 illustrates on a somewhat enlarged scale a top plan view of the product stuffing apparatus depicted in FIG. 1.

Belonging to the product stuffing apparatus or installation 10 is also, as already stated, the outfeed or delivery device or outfeeder 26 defining an outfeed or discharge station, of which only the starting portion 26*a* thereof has been conveniently depicted in FIGS. 1 and 2. This outfeed or delivery device or outfeeder 26 can in principle be constructed like the aforediscussed infeed devices or infeeders 21, 23, 24 and 25, however it is to be understood that the grippers 26b of such outfeed or delivery device 26 are designed in such a manner that they are accommodated to the dimensions and the weight of the final product 27 which has been collated from the newspaper 22 and the therein stuffed inserts A, B and C. The illustrated starting region of the outfeed device or outfeeder 26 is essentially in alignment with the delivery or outfeed region 21a of the infeed device or infeeder 21.

It is to be observed that the spacing of the infeed devices 21, 23, 24 and 25 and the outfeed device 26 from one another corresponds or is coordinated to the spacing of neighboring pockets or pocket members 11 and that the delivery or outfeed regions 21a, 23a, 24a and 25a of the infeeders 21, 23, 24 and 25, respectively, accompany over a certain path the path of movement of the pockets or pocket members 11.

Figure 3:
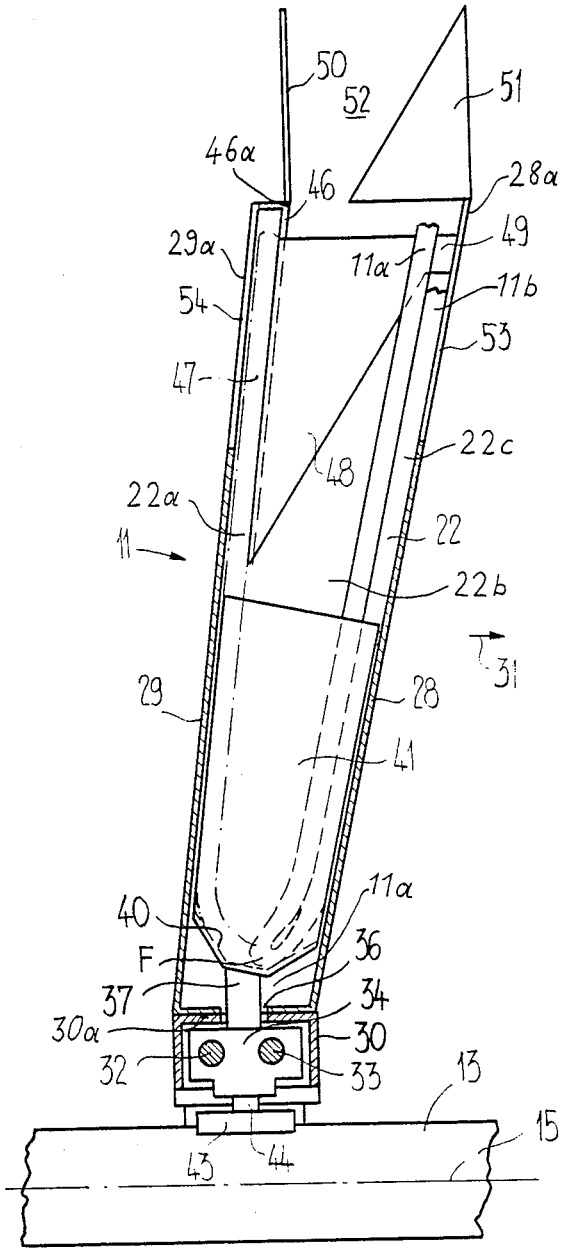
FIG. 3 is a cross-sectional view of the arrangement of FIG. 4 through one of the pockets, the sectional view being taken substantially along the line III—III of FIG. 4.
Figure 4:
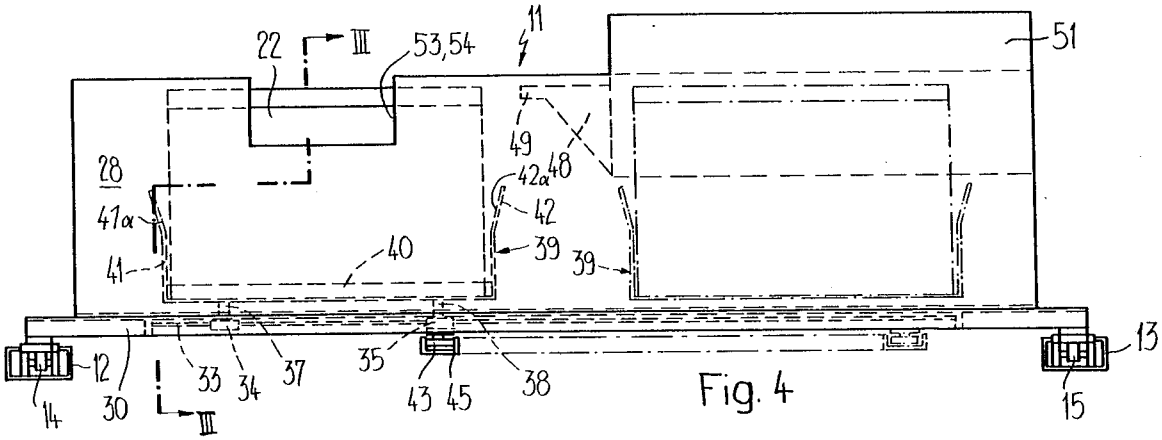
FIG. 4 is a front view of a pocket looking in the direction opposite to the direction of revolving or circulating motion of such pocket.
Figure 5:
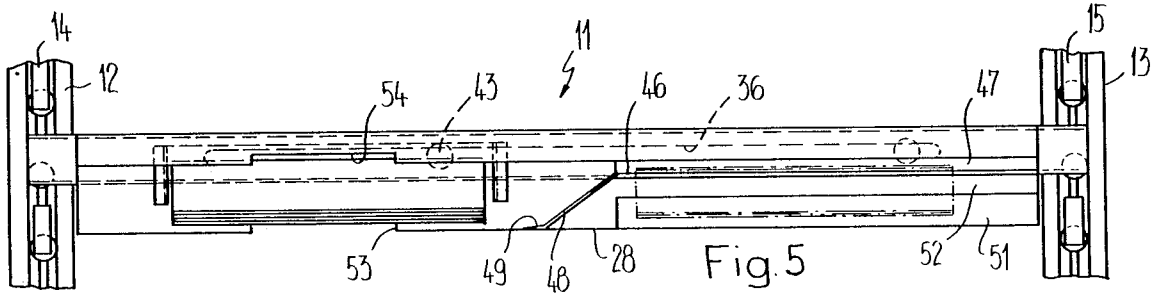
FIG. 5 is a top plan view of the pocket depicted in FIG. 4 when looking into the same.

Attention is now directed to FIGS. 3 to 5. Each of the pockets or pocket members 11 will be seen to possess a leading wall or panel 28 and a trailing wall or panel 29. Both pocket walls 28 and 29 are anchored at their lower flexed or angled edges, defining the floor portion 11a of the related pocket 11, at a hollow traverse or cross-member 30. This traverse or cross-member 30 possesses the shape of a downwardly open hollow profile or sectional member and, as best seen by referring to FIGS. 4 and 5, is appropriately anchored at its oppositely situated ends at the chains or chain members 14 and 15. Starting from the region of the traverse or cross-member 30 both of the pocket walls or panels 28 and 29 diverge away from another and, as clearly apparent from the illustration of FIG. 3, are inclined forwardly in the direction of revolving motion of the pockets or pocket members 11, which, as previously noted, has been generally indicated by the arrow 31 shown in FIGS. 1 and 2. Hence, the pockets or pocket members 11 move with a certain forward lean or forward inclination.

Internally of the hollow traverse or cross-member 30 there are fixedly mounted two guide rods 32 and 33 or equivalent guide elements which extend substantially parallel to and over a portion of the length of the related traverse or cross-member 30. The guide rods 32 and 33 piercingly extend through two slide elements or sliders 34 and 35, which are formed for instance of a suitable self-lubricating plastic material, and thus are freely displaceable upon the associated guide rods 32 and 33, respectively.

As apparent from the illustration of FIG. 3, the yoke or upper wall 30a of the traverse or cross-member 30 is provided with a longitudinal slot 36 through which extend stub shafts 37 and 38 carried by the associated slide members or sliders 34 and 35, respectively, and conveniently anchored or fastened thereto. At the upper end of the stub shafts 37 and 38 there is secured an associated carriage or sled, conveniently indicated by reference character 39 in FIG. 4. Each such carriage or sled 39 possesses a receiver trough or product catch element 40, at the opposite ends of which there is secured a related end wall 41 and 42. These end walls 41 and 42 are appreciably higher than the depth of the receiver trough 40 and are configured such that they fill with a slight play the intermediate space between the leading pocket wall or panel 28 and the trailing pocket wall or panel 29. The end walls 41 and 42, which extend approximately up to one half of the height of the related pocket walls 28 and 29, diverge away from one another at their respective upper end regions or ends 41a and 42a, as shown in FIG. 4, so that there is formed a suitable entry or inlet opening or region for the newspapers 22 and the inserts A, B, C which are delivered by the related infeed devices 21, 23, 24 and 25, respectively.

Extending downwardly from the slide member or slider 35 is a pin or plug member 44 which carries thereupon a freely rotatable roll or roller member 43. This roll or roller member 43, constitutes a cam follower or follower roll and engages with an upwardly open guide rail or track 45, constituting a cam structure, the course or configuration of which will be readily evident from the illustration of FIG. 2. As a matter of convenience and simplification of the showing of FIG. 1 the guide rail or rail member 45 has not been specifically depicted therein.

The carriage or sled 39 located in each pocket or pocket member 11 is disposed in a first terminal or end position when the related pocket or pocket member 11 is located in the product delivery or supply region of the infeed device or infeeder 21. Viewed in the direction of revolving or circulating motion 31 of the pockets or pocket members 11 the carriage or sled 39, with the now therein located newspaper 22, is shifted towards the left of the showing of FIG. 2, due to the coaction of the freely rotatable follower roll 43 with the guide rail or cam structure 45, into a second terminal or end position and travels while in the second terminal or end position beneath and past the respective delivery or outfeed regions 23a, 24a and 25a of the infeed devices or infeeders 23, 24 and 25. During this displacement of the carriage 39 the therein located newspaper 22 is positively opened by the product opening means which will be discussed more fully hereinafter. In this context reference will be shortly made to FIGS. 3, 4 and 5.

At the upper edge or top region 29a of the trailing pocket wall or panel 29, in its left-half portion as viewed in the direction of revolving motion 31 of the related pocket or pocket member 11, there is secured a guide member or element 46, for instance formed of sheet or metal plating, which extends into the interior of the associated pocket or pocket member 11. This guide member or element 46 is positioned such that there is formed a gap or space 47 between the guide member or element 46 and the inner side or surface of the trailing pocket wall or panel 29. This guide member or element 46 possesses a flexed or bent, approximately triangular-shaped projection or protuberance which terminates in a point or tip 49 and with this tip 49 touches, in the illustrated arrangement as shown in FIGS. 3 and 5, the inner side or surface of the leading pocket wall or panel 28. The newspaper 22 which has been inserted or stuffed by the infeed device or infeeder 21 into the related carriage or sled 39, as will be particularly evident by referring to FIG. 3, is folded so as to possess a so-called "pre-fold" or off-center fold, in other words, the newspaper 22 is not folded at its center, with the result that the one newspaper edge located opposite the product fold F protrudes beyond or overlaps the other edge of this newspaper 22. This has been depicted in FIG. 3 at the upper right-hand portion with full lines where there will be especially evident the marginal lap or overlap portion 11a.

Now if the carriage or sled 39 and together therewith the newspaper 22 located therein is displaced from the aforedescribed first terminal or end position towards the second terminal or end position, then the point or tip 49 of the guide member or element 46 only engages with the protruding edge or marginal lap 11a of the newspaper 22, whereas the other product edge 11*b* travels beneath the tip 49. The projection 48 of the guide member or element 46 then thus introduces the one-half or section 22*a* of the newspaper 22 which contains the protruding edge or marginal lap 11*a*, gradually into the gap or space 47, as such has been indicated in chain-dot lines in FIG. 3. The newspaper 22 is now open and, in turn, forms a sort of receiving pocket 22*b* which is ready to receive the inserts A, B and C.

It has already been mentioned that both the leading pocket wall or panel 28 as well as also the trailing pocket wall or panel 29 of each pocket 11 is forwardly inclined or forward leaning viewed with regard to the direction of revolving motion 31 of these pockets or pocket members 11. The purpose of this so-to-speak "forward lean" of the pockets 11 is to ensure that the newspapers 22 which have been released by the infeed device 21 and inserted into the pockets 11 will positively come to bear against the inner surface or side of the leading pocket wall or panel 28 into which each such associated newspaper 22 has been deposited.

With the heretofore described prior art apparatus disclosed in the aforementioned U.S. Pat. No. 4,496,141 there is required for this purpose the previously discussed contact plate, in other words a controlled and movable component. The newspapers 22 which have now been shifted or displaced into the aforediscussed second terminal or end position and thus opened in the manner likewise previously described, are located in the position depicted with chain-dot lines in FIG. 3. In this regard attention is also directed to the right-hand portion of the illustration of FIGS. 4 and 5 representative of the location of the newspapers 22 when they are opened and ready to receive the inserts A, B and C. To ensure that these inserts A, B and C which are supplied and subsequently released or dropped by the infeed devices or infeeders 23, 24 and 25 reliably arrive at the associated opened newspaper 22, there are undertaken the following measures. The upper edge 46*a* of the sheet metal guide member or element 46 is provided with a substantially flat projection or extension 50 which extends approximately vertically upwards as particularly well seen by referring to FIG. 3. Furthermore, at the upper edge or region 28*a* of the leading pocket wall or panel 28 there is attached a substantially wedge-shaped guide member 51, for instance formed of sheet metal or metal plating, which extends transversely with respect to the direction of revolving or circulating movement 31 of the pockets or pocket members 11.

The projection or extension 50 and the guide member 51 delimit therebetween a downwardly converging or tapering infeed slot or opening 52 through which drop the inserts A, B and C into the open newspaper 22 or the like. Since, however, the entire pocket or pocket member 11 is inclined or leans forwardly in the direction of revolving motion 31 of such pocket 11, each of the inserts A, B and C, as soon as it has passed with its trailing edge the guide member 51, will be caused to come to bear at that half or section 22*c* of the newspaper 22 which already bears at the leading pocket wall or panel 28 of the associated or related pocket 11, in other words so-to-speak in the "shadow" of the guide member 51. As a result there is ensured that the leading edges of the inserts B and C, dropped into the related pocket or pocket member 11, will be stuffed completely into the open newspaper 22 up to the location of its fold or fold edge F and into contact therewith and will not impact for instance at the upper edge of the already previously introduced insert A.

As will be particularly evident from FIG. 2, as soon as all of the inserts A, B and C have been stuffed into the newspaper 22 located in an associated pocket 11, the guide rail or rail member 45 displaces the related carriage or sled 39 and together therewith the now completely finalized or collated end product 27 back into the first terminal or end position. In this first terminal or end position the finalized or completed end product 27 can be engaged by the outfeed device or outfeeder 26 of the discharge station, lifted out of the related pocket 11 and transported away. During such displacement of the carriage or sled 39 back into the first terminal or end position the previously infed inserts A, B and C are also aligned with respect to the newspaper 22 which has received these inserts A, B and C.

As already explained, the finalized or completed end product 27 can possess an appreciable weight and therefore the grippers 26*b* of the outfeed device or outfeeder 26 must be accordingly designed. So that the grippers 26*b* of the outfeeder device or outfeeder 26 have unobstructed access to the upper edge or marginal region of the final or finalized or completed end product 27 both the leading pocket wall or panel 28 as well as also the trailing pocket wall or panel 29 of each pocket 11 is beneficially provided with a cut-out or recess 53 and 54, respectively, as particularly well illustrated in FIGS. 4 and 5.

Following removal of the finalized or completed end product 27 the empty pockets or pocket members 11 together with the carriages or sleds 39 which are now located in their first terminal or end position accomplish their return movement in the lower, empty and returning pocket run.

Although as a matter of convenience in the prior discussion the description was previously undertaken with regard to newspapers 22 and inserts A, B and C, it should be understood that in the case of the so-called "newspapers" such may be constituted by the so-termed primary product, that is to say, the most current or newsworthy section of a newspaper and in the case of the so-called "inserts" such constitute the so-termed pre-products or supplements, in other words, portions of the final product, whose content is less current or newsworthy and therefore, if desired, can already be preprinted, whereas the primary or main product still is being printed.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An apparatus for stuffing inserts into multi-sheet printed products, especially newspapers, comprising:

endless revolving drive elements;

a plurality of substantially similar pockets arranged in a closely spaced row;

each of said pockets having an open upper region and serving for the reception of at least one printed product;

said pockets being secured in said closely spaced row to said endless revolving drive elements in a direction extending substantially transverse to the open upper region of the pockets for movement in a predetermined direction of revolving motion;

respective infeed means defining infeed stations for successively infeeding at least one printed product into each of the pockets and thereafter at least one insert into each pocket containing said at least one printed product;

at least one discharge station for removing said at least one printed product and the therein contained at least one insert from each pocket;

said pockets successively moving past said infeed stations and said discharge station;

means provided for each pocket for opening the at least one printed product inserted therein so as to be able to receive the at least one insert subsequently deposited into said at least one open printed product;

an entrainment element arranged in each pocket and serving to receive the at least one printed product deposited into such pocket;

means for controllably displacing each said entrainment element from a first terminal position into a second terminal position in a direction transverse to the predetermined direction of revolving motion of the pockets;

said opening means for opening the printed products comprising a product opening member provided for each pocket;

each said product opening member being stationarily arranged in relation to its related pocket; and each said product opening member opening the printed product disposed in the associated pocket and entrained by the entrainment element of such pocket during the course of movement of the entrainment element and therewith the printed product from the first terminal position into the second terminal position.

2. The apparatus as defined in claim 1, wherein:

said product opening member comprises a product opening wedge.

3. The apparatus as defined in claim 1, wherein:

each said entrainment element comprises a carriage;

said controllably displacing means for said carriage comprising a stationary cam member; and said controllably displacing means further comprising a follower member provided for each said carriage and engageable with said stationary cam member.

4. The apparatus as defined in claim 3, wherein:

each pocket has a floor portion from which protrudes a stub shaft; and the follower member of each pocket comprising a roller freely rotatably mounted on the stub shaft of the associated pocket.

5. The apparatus as defined in claim 3, wherein:

said stationary cam member is structured such that each carriage after attaining and residing in the second terminal position and following completion of the printed product with the at least one insert stuffed therein is again shifted back into the first terminal position.

6. The apparatus as defined in claim 5, wherein:

each pocket has a floor portion from which protrudes a stub shaft; and the follower member of each pocket comprising a roller freely rotatably mounted on the stub shaft of the associated pocket.

7. The apparatus as defined in claim 6, further including:

guide means provided for each pocket and extending along the floor portion of each said pocket; and the carriage of each pocket being provided with slide members displaceably guided by said guide means for enabling displacement of each carriage from the first terminal position into the second terminal position and back again into the first terminal position.

8. The apparatus as defined in claim 3, wherein:

each said pocket has a floor portion;

each carriage comprising a receiver trough extending substantially parallel to the floor portion of the associated pocket;

each said receiver trough having oppositely situated ends; and said oppositely situated ends of each receiver trough being bounded by an end wall.

9. The apparatus as defined in claim 8, wherein:

each of said receiver troughs has side edges;

said end walls having upper ends; and said end walls protruding past the side edges of the associated receiver trough and diverging from one another at their upper ends.

10. The apparatus as defined in claim 1, wherein:

each of said pockets comprises a leading pocket wall and a trailing pocket wall;

both of said pocket walls, viewed in said predetermined direction of revolving motion of the pockets, being forwardly inclined;

each said trailing pocket wall having an upper region;

said product opening member comprising a guide member secured at the upper region of the trailing pocket wall while maintaining free a gap;

said guide member having a flexed tapered projection having a free end; and said free end of said flexed tapered projection extending at the neighborhood of the leading pocket wall.

11. An apparatus for stuffing inserts into multi-sheet primary products, comprising:

endless revolving drive elements;

a plurality of pockets arranged in a predeterminate spacing from one another;

each of said pockets having an open upper region and serving for the reception of at least one primary product;

said pockets being secured at said predeterminate spacing from one another to said endless revolving drive elements in a direction extending substantially transverse to the open upper region of the pockets and for movement in a predetermined direction;

respective infeed means for successively infeeding at least one primary product into each of the pockets and thereafter at least one insert into each pocket containing said at least one primary product;

at least one outfeed means for removing said at least one primary product and the therein contained at least one insert from each pocket;

said pockets successively moving past said infeed means and said outfeed means;

means provided for each pocket for opening the at least one primary product inserted therein so as to be able to receive the at least one insert subsequently deposited into said at least one open primary product;

an entrainment element arranged in each pocket and serving to receive the at least one primary product deposited into such pocket;

means for controllably displacing each said entrainment element from a first terminal position into a second terminal position in a direction transverse to the predetermined direction of movement of the pockets;

said opening means for opening the primary products comprising a product opening member provided for each pocket;

each said product opening member being stationarily arranged in relation to its related pocket; and each said product opening member opening the primary product disposed in the associated pocket and entrained by the entrainment element of such pocket during the course of movement of the entrainment element and therewith the primary product from the first terminal position into the second terminal position.

* * * * *